US010319330B2

(12) United States Patent
Li et al.

(10) Patent No.: US 10,319,330 B2
(45) Date of Patent: Jun. 11, 2019

(54) FLICKER CONTROL CIRCUITS FOR LIQUID CRYSTAL DEVICES

(71) Applicant: Shenzhen China Star Optoelectronics Technology Co., Ltd., Shenzhen, Guangdong (CN)

(72) Inventors: Wenfang Li, Guangdong (CN); Xianming Zhang, Guangdong (CN); Xinhong Chen, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 397 days.

(21) Appl. No.: 15/312,629

(22) PCT Filed: Sep. 27, 2016

(86) PCT No.: PCT/CN2016/100450

§ 371 (c)(1),
(2) Date: Nov. 19, 2016

(87) PCT Pub. No.: WO2018/040165

PCT Pub. Date: Mar. 8, 2018

(65) Prior Publication Data

US 2018/0182348 A1 Jun. 28, 2018

(30) Foreign Application Priority Data

Aug. 31, 2016 (CN) ..... 2016 1 0779826

(51) Int. Cl.
*G09G 3/36* (2006.01)
*G05F 3/08* (2006.01)

(52) U.S. Cl.
CPC ..... *G09G 3/3696* (2013.01); *G05F 3/08* (2013.01); *G09G 2320/0247* (2013.01); *G09G 2330/02* (2013.01)

(58) Field of Classification Search
CPC ..... G09G 3/3696; G09G 2320/0247; G09G 2330/02; G05F 3/08
See application file for complete search history.

(56) References Cited

U.S. PATENT DOCUMENTS

2010/0182300 A1* 7/2010 Kato ..... G09G 3/3685 345/211
2010/0194728 A1* 8/2010 Shingai ..... G09G 3/3622 345/208

* cited by examiner

*Primary Examiner* — Sejoon Ahn
(74) *Attorney, Agent, or Firm* — Andrew C. Cheng

(57) ABSTRACT

A flicker control circuit of liquid crystal devices (LCDs) includes a main control chip, a low differential voltage regulator (LDO) circuit, a first resistor, a second resistor, and a reset resistor. The main control chip includes an operational voltage input end, a common voltage output end, and a dividing reference voltage input end. The LDO circuit receives a voltage provided by an external power module and generates a dividing reference voltage in accordance with the received voltage. One end of the first resistor connects to the LDO circuit to receive the dividing reference voltage, and the other end of the first resistor connects to the dividing reference voltage input end. The flicker of the LCDs may be reduced such that the display performance of the LCDs may be enhanced.

2 Claims, 4 Drawing Sheets

FLICKER CONTROL CIRCUITS FOR LIQUID CRYSTAL DEVICES

BACKGROUND OF THE INVENTION

1. Field of the Invention

The present disclosure relates to liquid crystal display technology, and more particularly to a flicker control circuit of liquid crystal devices (LCDs).

2. Discussion of the Related Art

Currently, liquid crystal panels and control boards (CBs) may be separately shipped out in some business models. Under such circumstances, errors may exist due to the errors caused by the components, such as resistors or integrated chips (ICs), within the CB, the external operational voltages, and the difference between the reference voltages and the common voltage. Thus, the optical common voltage of a variety of CBs may be different for one liquid crystal panel. During the mass production, the auto gamma process is applied to various CBs to obtain the corresponding parameters for achieving the optical flicker control. The parameters are saved within the Flash memory with the liquid crystal panel. However, different CBs may be adopted randomly in the liquid crystal panels. The above errors, such as the operational voltage and the difference between the reference voltage and the common voltage, may cause flicker.

When the voltage span of the liquid crystals is close to the frequency of the response time of user eyes, users may observe the flicker due to the changed grayscale. The flicker may be worse when the voltage is asymmetrical due to the inversed polarity. In an example, when the optimal flicker is 20 after being applied with the auto gamma process, the flicker may reach 80 if a different CB is adopted. A control range of the operational voltage provided externally may be in a range from 15.3+ to −0.3V with the deviation equaling to 0.6V. FIG. 1 is a schematic view showing the P-GammaIC on one conventional CB, wherein the common voltage (VCOM) may be obtained by equation 1 below:

$$\text{VCOM}=R2/(R1+R2)*[VAA1-VAA2*R1*(n+1)/2560*R\text{set}], \quad \text{Equation 1:}$$

Wherein VAA2 indicates the operational voltage of the Pgamma IC and the VAA2 is provided by an external power module, VAA1 indicates a partial voltage of the common voltage (VCOM) generated by the Pgamma IC and the VAA1 is also provided by one external power module, the $V_{gamma}$ indicates a Gamma reference voltage generated by Pgamma IC and the $V_{gamma}$ is provided to the common electrode of the display panel. The VAA1 and the VAA2 have different functions while the voltage values are the same and are provided by the same external power module.

In view of Equation 1, as the control ranges of VAA1 and VAA2 are in the range from 15.3+ to −0.3V with the deviation equaling to 0.6V, and thus the common voltage (VCOM) may be in great impact caused by the VAA1 and VAA2, that is, the flicker may be worse.

SUMMARY

To overcome the above problems, a flicker control circuit of LCDs is proposed to reduce the flicker of LCDs so as to enhance the display performance of LCDs.

In one aspect, a flicker control circuit of liquid crystal devices (LCDs) includes: a main control chip, a low differential voltage regulator (LDO) circuit, a first resistor, a second resistor, and a reset resistor; the main control chip includes an operational voltage input end, a common voltage output end, and a dividing reference voltage input end; the LDO circuit receives a voltage provided by an external power module and generates a dividing reference voltage in accordance with the received voltage; one end of the first resistor connects to the LDO circuit to receive the dividing reference voltage, and the other end of the first resistor connects to the dividing reference voltage input end; one end of the second resistor connects to the other end of the first resistor, and the other end of the second resistor is electrically grounded;

one end of the reset resistor connects to the main control chip, and the other end of the reset resistor is electrically grounded; the operational voltage input end receives the voltage provided by the external power module, and the voltage operates as the operational voltage of the main control chip, and the common voltage output end outputs a common voltage generated by the main control chip, and the common voltage and the dividing reference voltage are in a positive correlation.

Wherein the common voltage and the dividing reference voltage increases or decreases along the same direction.

Wherein the common voltage is:

$$\text{VCOM}=R2/(R1+R2)*[\text{VREF2}-VAA*R1*(n+1)/(2560*R\text{set})];$$

wherein VCOM indicates the common voltage, R1 indicates a resistance value of the first resistor, R2 indicates the resistance value of the second resistor, Rset indicates the resistance value of the reset resistor, VREF2 indicates the dividing reference voltage, VAA indicates the voltage provided by the external power module, and n is an integer in a range from 0 to 127.

Wherein a voltage drop of the LDO circuit is 0.3, and a current reaches 100 mA.

Wherein the LDO circuit includes a voltage regulation chip, a first capacitor, a second capacitor, a third capacitor, a fourth capacitor, a fifth capacitor, a sixth capacitor, a third resistor, a fourth resistor, and a fifth resistor; and ends of the first capacitor, the second capacitor, the third capacitor, and the third resistor receive the voltage provided by the external power module, the other ends of the first capacitor, the second capacitor, the third capacitor, and the third resistor connect to the voltage regulation chip, ends of the fourth capacitor, the fifth capacitor, the sixth capacitor, and the fifth resistor connect to the first resistor and the voltage regulation chip, one end of the fourth resistor connects to the other end of the fifth resistor and to the voltage regulation chip, the first capacitor, the second capacitor, the third capacitor, the fourth capacitor, the fifth capacitor, the sixth capacitor, and the other end of the fourth resistor are electrically grounded.

In another aspect, a flicker control circuit of liquid crystal devices (LCDs) includes: a main control chip, a low differential voltage regulator (LDO) circuit, a first resistor, a second resistor, and a reset resistor; the main control chip includes an operational voltage input end, a common voltage output end, and a dividing reference voltage input end; the LDO circuit receives a voltage provided by an external power module and generates a dividing reference voltage in accordance with the received voltage; one end of the first resistor connects to the LDO circuit to receive the dividing reference voltage, and the other end of the first resistor connects to the dividing reference voltage input end; one end of the second resistor connects to the other end of the first resistor, and the other end of the second resistor is electrically grounded; one end of the reset resistor connects to the main control chip, and the other end of the reset resistor is electrically grounded; the operational voltage input end receives the generated dividing reference voltage operating as the operational voltage of the main control chip, and the common voltage output end outputs a common voltage generated by the main control chip, and the common voltage and the dividing reference voltage are in a positive correlation.

Wherein the common voltage and the dividing reference voltage increases or decreases along the same direction.

Wherein the common voltage is:

$$VCOM=R2/(R1+R2)*[VREF2-VAA*R1*(n+1)/(2560*Rset)];$$

wherein VCOM indicates the common voltage, R1 indicates a resistance value of the first resistor, R2 indicates the resistance value of the second resistor, Rset indicates the resistance value of the reset resistor, VREF2 indicates the dividing reference voltage, VAA indicates the voltage provided by the external power module, and n is an integer in a range from 0 to 127.

Wherein a voltage drop of the LDO circuit is 0.3, and a current reaches 100 mA.

Wherein the LDO circuit includes a voltage regulation chip, a first capacitor, a second capacitor, a third capacitor, a fourth capacitor, a fifth capacitor, a sixth capacitor, a third resistor, a fourth resistor, and a fifth resistor; and ends of the first capacitor, the second capacitor, the third capacitor, and the third resistor receive the voltage provided by the external power module, the other ends of the first capacitor, the second capacitor, the third capacitor, and the third resistor connect to the voltage regulation chip, ends of the fourth capacitor, the fifth capacitor, the sixth capacitor, and the fifth resistor connect to the first resistor and the voltage regulation chip, one end of the fourth resistor connects to the other end of the fifth resistor and to the voltage regulation chip, the first capacitor, the second capacitor, the third capacitor, the fourth capacitor, the fifth capacitor, the sixth capacitor, and the other end of the fourth resistor are electrically grounded.

In view of the above, the partial voltage of the common voltage is changed to be the dividing reference voltage by the LDO circuit, such that the common voltage is affected by the dividing reference voltage. As the precision of the dividing reference voltage is higher, the precision of the common voltage is enhanced. In addition, as the common voltage may change in accordance with the dividing reference voltage along the same direction, the image flicker of the LCD may be reduced.

BRIEF DESCRIPTION OF THE DRAWINGS

Embodiments of the invention will now be described more fully hereinafter with reference to the accompanying drawings, in which embodiments of the invention are shown.

DETAILED DESCRIPTION OF THE EMBODIMENTS

Figure 1:
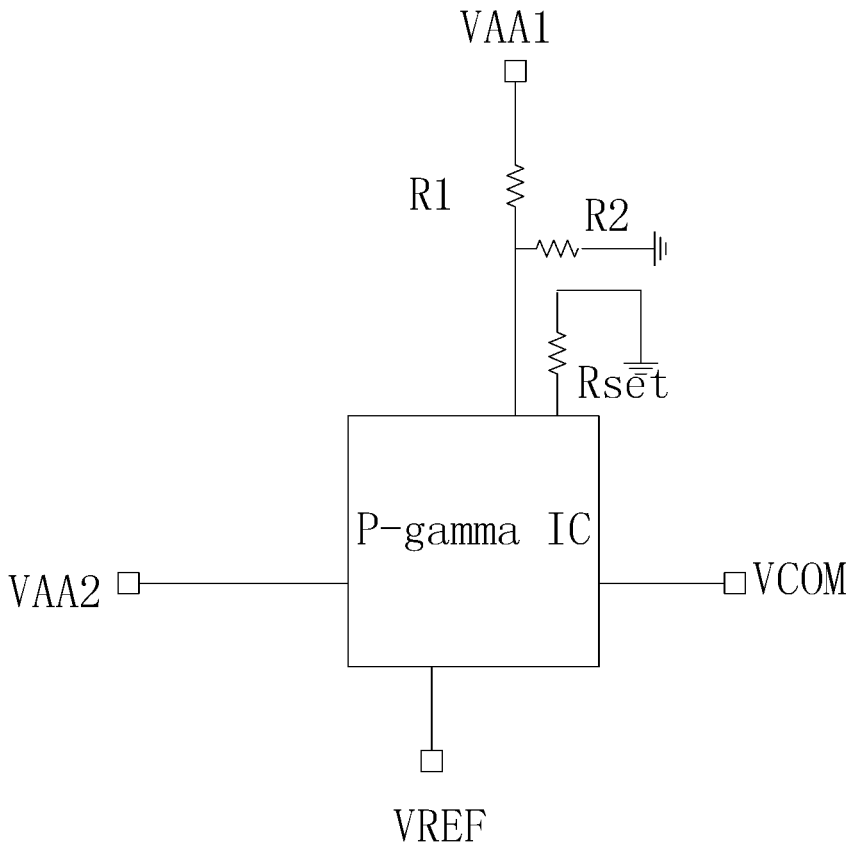
FIG. 1 is a schematic view showing the conventional flicker control circuit of LCDs.

Various example embodiments will now be described more fully with reference to the accompanying drawings in which some example embodiments are shown. In the drawings, the thicknesses of layers and regions may be exaggerated for clarity. In the following description, in order to avoid the known structure and/or function unnecessary detailed description of the concept of the invention result in confusion, well-known structures may be omitted and/or functions described in unnecessary detail.

Figure 2:
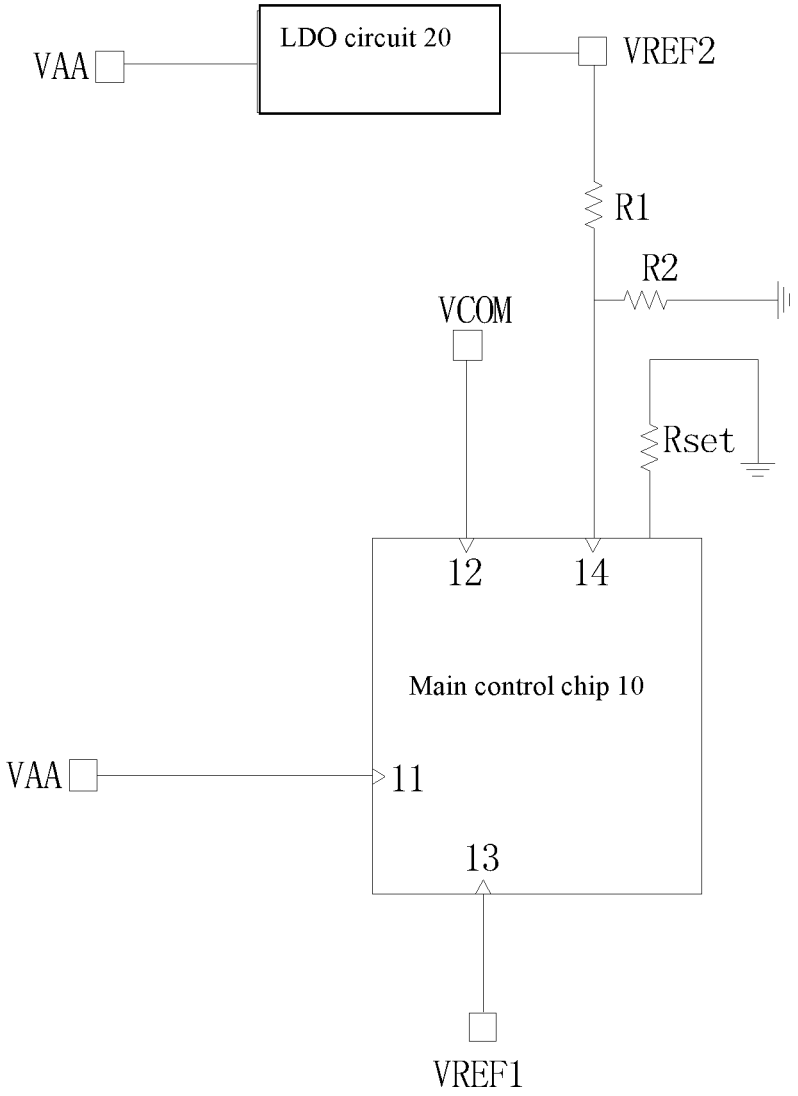
FIG. 2 is a circuit diagram of the flicker control circuit of LCDs in accordance with one embodiment.

FIG. 2 is a circuit diagram of the flicker control circuit of LCDs in accordance with one embodiment.

Referring to FIG. 2, the flicker control circuit includes a main control chip 10, a low differential voltage regulator (LDO) circuit 20, a first resistor (R1) connected to the main control chip 10, a second resistor (R2) connected to the main control chip 10, and a reset resistor (Rset). The main control chip 10 includes an operational voltage input end 11 for receiving an operation voltage (VAA) provided by an external power module, a common voltage output end 12 for outputting a common voltage (VCOM) to a common electrode of a display panel, a Gamma voltage output end 13 for outputting a Gamma reference voltage (VREF1) to a data driver of the display panel, and a dividing reference voltage input end 14 for receiving a dividing reference voltage (VREF2) inputted via the first resistor (R1). In the embodiment, the main control chip 10 may be a programmable Gamma correction buffer chip (P-GammaIC), but the present disclosure is not limited thereto.

One end of the LDO circuit 20 receives the operation voltage (VAA), and the other end of the LDO circuit 20 connects to the dividing reference voltage input end 14 via the first resistor (R1). One end of the second resistor (R2) connects between the first resistor (R1) and the dividing reference voltage input end 14, and the other end of the second resistor (R2) is electrically grounded. The LDO circuit 20 generates the dividing reference voltage (VREF2) in accordance with the operation voltage (VAA).

Figure 3:
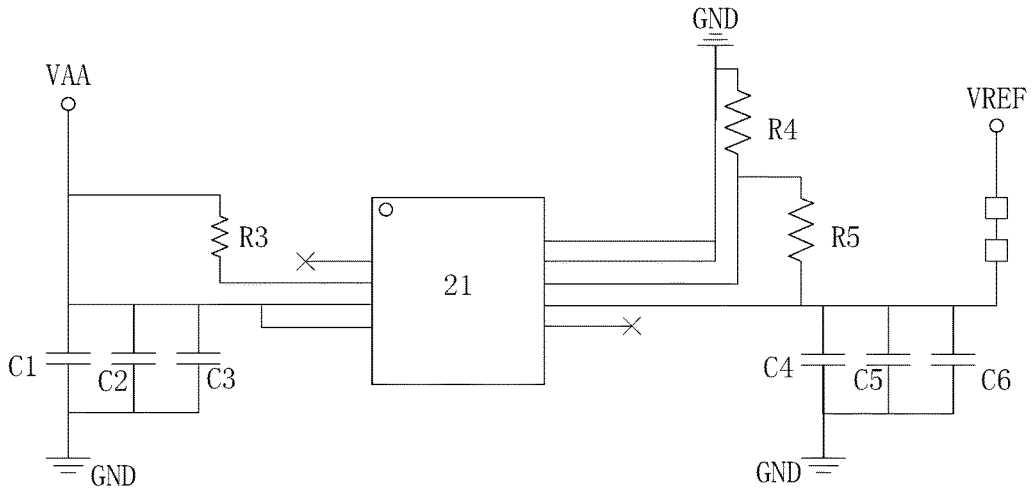
FIG. 3 is a circuit diagram of the LDO circuit of the flicker control circuit of LCDs in accordance with one embodiment.

FIG. 3 is a circuit diagram of the LDO circuit of the flicker control circuit of LCDs in accordance with one embodiment. The LDO circuit 20 includes a voltage regulation chip 21, a first capacitor (C1), a second capacitor (C2), a third capacitor (C3), a fourth capacitor (C4), a fifth capacitor (C5), a sixth capacitor (C6), a third resistor (R3), a fourth resistor (R4), and a fifth resistor (R5).

Ends of the first capacitor (C1), the second capacitor (C2), the third capacitor (C3), and the third resistor (R3) receive the operation voltage (VAA), and the other ends of the first capacitor (C1), the second capacitor (C2), the third capacitor (C3), and the third resistor (R3) connect to the voltage regulation chip 21. Ends of the fourth capacitor (C4), the fifth capacitor (C5), the sixth capacitor (C6), and the fifth resistor (R5) connect to the first resistor (R1) and the voltage regulation chip 21. One end of the fourth resistor (R4) connects to the other end of the fifth resistor (R5) and to the voltage regulation chip 21. The capacitors (C1, C2, C3, C4, C5, and C6) and the other end of the fourth resistor (R4) connect to a grounding end (GND).

In view of FIGS. 2 and 3, the voltage drop of the LDO circuit 20 may be 0.3V, and the current may be 100 mA. At this moment, the common voltage (VCOM) may be:

$$VCOM=R2/(R1+R2)*[VREF2-VAA*R1*(n+1)/(2560*RSET)],$$

wherein n is an integer in a range from 0 to 127. The common voltage (VCOM) may be affected by the operation voltage (VAA) and the dividing reference voltage (VREF2). As the precision of the dividing reference voltage (VREF2) is higher than the precision of the operation voltage (VAA), the precision of the common voltage (VCOM) may be enhanced. In addition, as the common voltage (VCOM) may change in accordance with the dividing reference voltage (VREF2) along the same direction, the image flicker of the LCD may be reduced.

Figure 4:
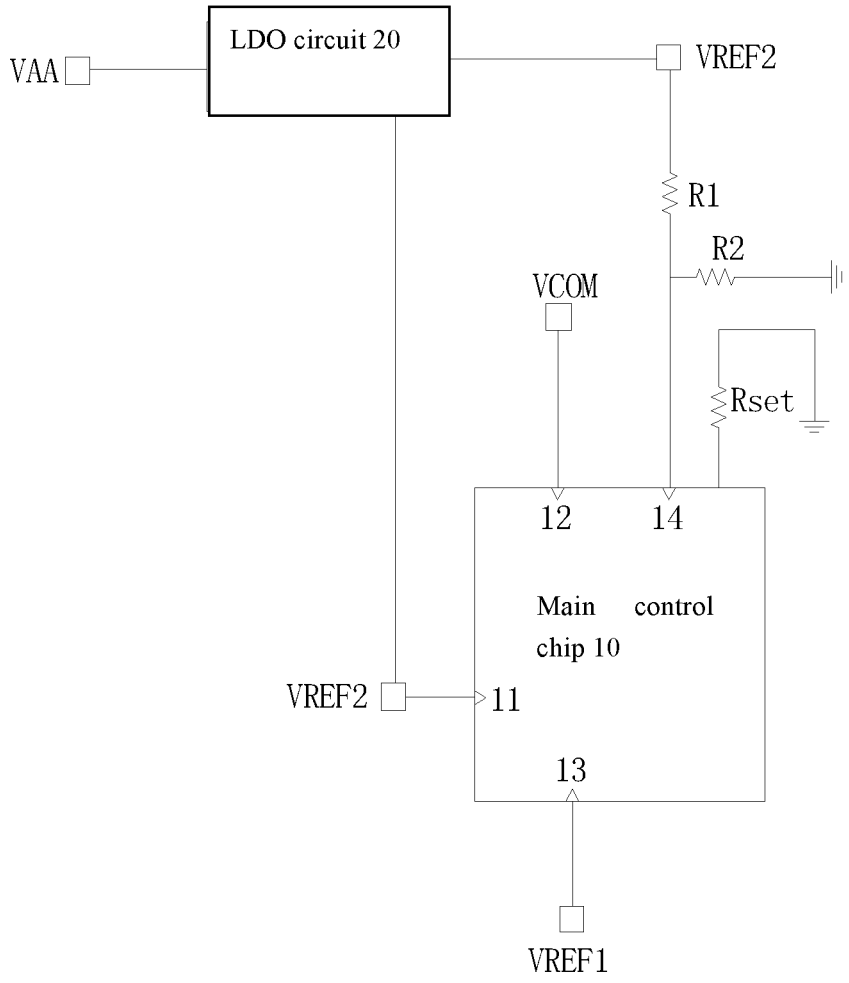
FIG. 4 is a circuit diagram of the flicker control circuit of LCDs in accordance with another embodiment.

FIG. 4 is a circuit diagram of the flicker control circuit of LCDs in accordance with another embodiment.

Referring to FIG. 4, the difference between the flicker control circuit and that in FIG. 2 resides in that: the operational voltage input end 11 may also connect to the LDO circuit 20 to receive the dividing reference voltage (VREF2) operating as a power supply voltage of the main control chip 10. At this moment, the common voltage (VCOM) may be:

$$VCOM=R2/(R1+R2)*[VREF2-VREF2*R1*(n+1)/(2560*RSET)],$$

wherein n is an integer in a range from 0 to 127. The common voltage (VCOM) may be also affected by the dividing reference voltage (VREF2). As the precision of the dividing reference voltage (VREF2) is higher than the precision of the operation voltage (VAA), the precision of the common voltage (VCOM) may be enhanced. In addition, as the common voltage (VCOM) may change in accordance with the dividing reference voltage (VREF2) along the same direction, the image flicker of the LCD may be reduced.

In view of the above, the voltage drop of the LDO circuit 20 may be 0.3V, and the current may be 100 mA. In addition, the partial voltage of the common voltage (VCOM) may be the dividing reference voltage (VREF2) such that the common voltage (VCOM) may be affected by the dividing reference voltage (VREF2). As the precision of the dividing reference voltage (VREF2) is higher than the precision of the operation voltage (VAA), the precision of the common voltage (VCOM) may be enhanced. In addition, as the common voltage (VCOM) may change in accordance with the dividing reference voltage (VREF2) along the same direction, the image flicker of the LCD may be reduced.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A flicker control circuit of liquid crystal display (LCD) device, comprising:

a main control chip, a low differential voltage regulator (LDO) circuit, a first resistor, a second resistor, and a reset resistor;

the main control chip comprises an operational voltage input end, a common voltage output end, and a dividing reference voltage input end;

the LDO circuit receives a voltage provided by an external power module and generates a dividing reference voltage in accordance with the received voltage;

one end of the first resistor connects to the LDO circuit to receive the dividing reference voltage, and the other end of the first resistor connects to the dividing reference voltage input end;

one end of the second resistor connects to the other end of the first resistor, and the other end of the second resistor is electrically grounded;

one end of the reset resistor connects to the main control chip, and the other end of the reset resistor is electrically grounded;

the operational voltage input end receives the voltage provided by the external power module, and the voltage operates as the operational voltage of the main control chip, and the common voltage output end outputs a common voltage generated by the main control chip, and the common voltage and the dividing reference voltage are in a positive correlation, wherein the common voltage includes:

$$VCOM=R2/(R1+R2)*[VREF2-VAA*R1*(n+1)/(2560*Rset)];$$

wherein VCOM indicates the common voltage, R1 indicates a resistance value of the first resistor, R2 indicates the resistance value of the second resistor, Rset indicates the resistance value of the reset resistor, VREF2 indicates the dividing reference voltage, VAA indicates the voltage provided by the external power module, and n is an integer in a range from 0 to 127, wherein a voltage drop of the LDO circuit is 0.3, and a current reaches 100 mA, wherein the LDO circuit comprises a voltage regulation chip, a first capacitor, a second capacitor, a third capacitor, a fourth capacitor, a fifth capacitor, a sixth capacitor, a third resistor, a fourth resistor, and a fifth resistor; and ends of the first capacitor, the second capacitor, the third capacitor, and the third resistor receive the voltage provided by the external power module, the other ends of the first capacitor, the second capacitor, the third capacitor, and the third resistor connect to the voltage regulation chip, ends of the fourth capacitor, the fifth capacitor, the sixth capacitor, and the fifth resistor connect to the first resistor and the voltage regulation chip, one end of the fourth resistor connects to the other end of the fifth resistor and to the voltage regulation chip, the first capacitor, the second capacitor, the third capacitor, the fourth capacitor, the fifth capacitor, the sixth capacitor, and the other end of the fourth resistor are electrically grounded.

2. The flicker control circuit of LCD as claimed in claim 1, wherein the common voltage and the dividing reference voltage increases or decreases along the same direction.

* * * * *